US006158069A

United States Patent [19]

Boothe

[11] Patent Number: 6,158,069

[45] Date of Patent: Dec. 12, 2000

[54] ARM LOUNGER

[76] Inventor: Annette Boothe, P.O. Box 1704, 4136 Post Rd., Cumming, Ga. 30028

[21] Appl. No.: 09/188,455

[22] Filed: Nov. 9, 1998

[51] Int. Cl.[7] ..... A47C 7/54

[52] U.S. Cl. ..... 5/646; 5/623; 5/658

[58] Field of Search ..... 5/646, 623, 658; 297/411.1, 35, 37, 115, 411.23, 411.24, 440.23, 411.2

[56] References Cited

U.S. PATENT DOCUMENTS

| | | | |
|---|---|---|---|
| 2,609,261 | 9/1952 | Parker | 311/9 |
| 2,630,288 | 3/1953 | Eubanks | 248/125 |
| 2,766,463 | 10/1956 | Bendersky | 5/618 |
| 4,078,783 | 3/1978 | Schwartz et al. | 5/618 |
| 4,894,877 | 1/1990 | Marsh | 5/618 |
| 5,074,291 | 12/1991 | Carter | 128/84 R |
| 5,391,132 | 2/1995 | Greenwald | 482/91 |
| 5,758,374 | 6/1998 | Ronci | 5/507.1 |
| 5,797,655 | 8/1998 | Miles | 297/411.23 |

*Primary Examiner*—Terry Lee Melius
*Assistant Examiner*—Fredrick Conley

[57] ABSTRACT

An arm rest adapted for use with a lounge chair, in which the arm rest comprises a five-sided tubular frame; a covering material which connects with each side of the tubular frame; an adjustable support for the arm rest; and means for connecting the arm rest to the lounge chair.

8 Claims, 4 Drawing Sheets

ARM LOUNGER

TECHNICAL FIELD

This invention relates to a person resting their arms while lounging or sunbathing so as to acquire an even tan on arms and upper torso with comfort.

BACKGROUND

Much time and money is spent on a person trying to acquire that perfect even tan. As a sunbather I've always felt there should be an easier more comfortable means of getting an even tan on arms and upper torso other than letting ones arms flop over and hang down off a chair.

SUMMARY OF INVENTION

In accordance with one aspect of the present invention a tool is provided to be used as portable or permanent on a chaise for the intent of an even tan on arms and upper torso, or for the purpose of enhancing relaxation while simply lounging. While using the portable arm rest you take the cord that is attached to first end of the arm rest and secure it to the chaise lounge by tying a slip knot or bow knot, then one extends the length of the adjustable leg that is at the second end of the arm rest to the desired height.

While using as a permanent arm rest a person needs to attach the arm rest to a chaise lounge by means of a screw, nut, and a interlocking eyebolt, thus eliminating the need for the cord.

BRIEF DESCRIPTION OF THE DRAWING

A more complete understanding of the invention can be had by referring to the following Detailed Description, taken with the accompanying drawings, wherein.

DETAILED DESCRIPTION

Depending on preference, the "Arm Lounger" can be made as an integral unit of one material, such as plastic, aluminum or any other material that is found suitable, or in two parts welded, glued, or otherwise secured together, which permits parts of the arm rest to be made of different materials. While only a single embodiment of the invention has been illustrated in the accompanying drawings and described in the foregoing Detailed Description, it will be understood that the invention is not limited to the embodiment disclosed, but is capable of numerous arrangements modifications and substitutions of parts and elements without departing from the spirit of the invention.

DETAILED DESCRIPTION

Figure 1:
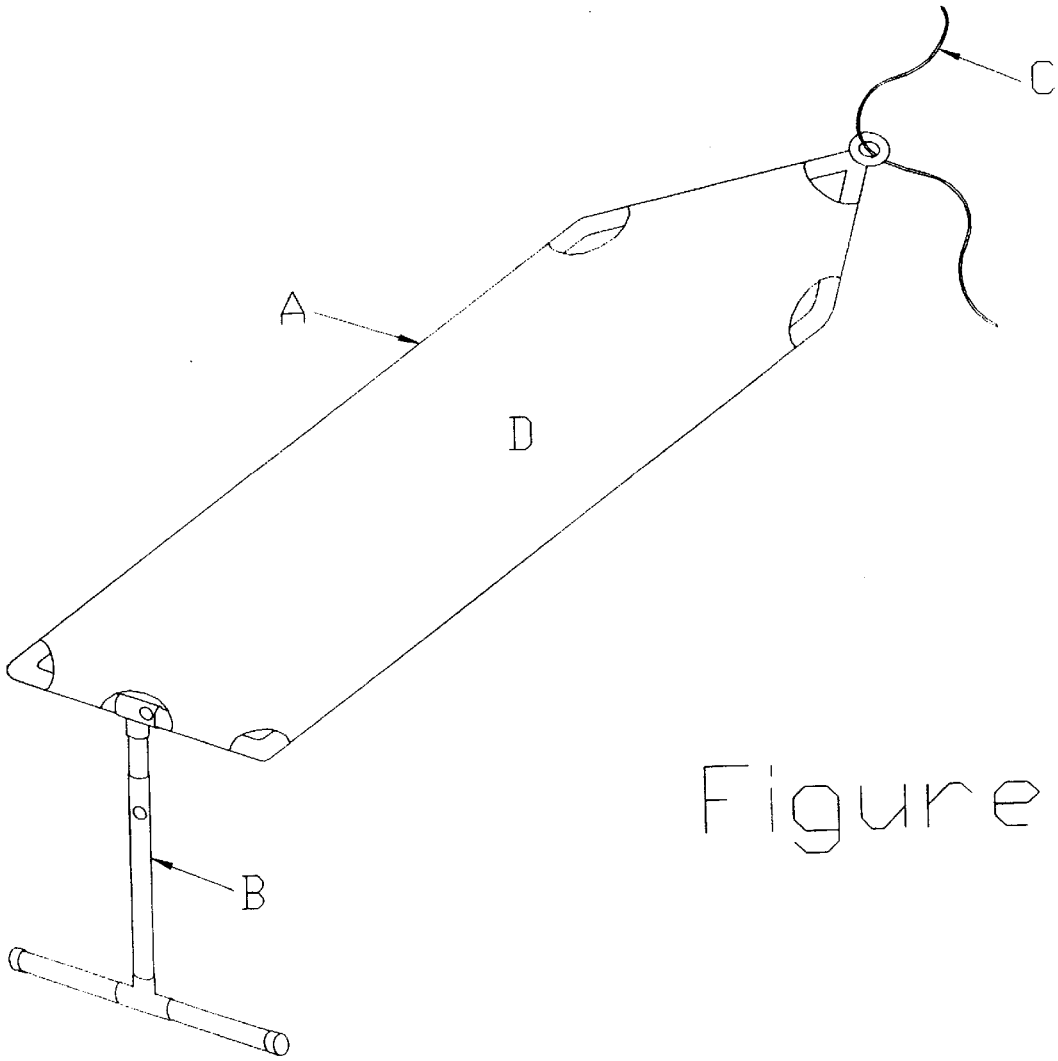
FIG. 1 is the full view of the portable arm rest.

Referring now to illustration of FIG. 1:

(A) is a 60" shaped and formed tubular material; in aluminum, PVC, or any material that can be shaped into a frame for the arm rest as shown in the drawing of FIG. 1. The frame after molding is 22" on each long side and 6" on the second end which the adjustable leg marked (B) fits into. The first end is shaped in a V-shape with each side measuring 5". Because of its V-shaped it allows the user to adjust the arm rest horizontally back and forth for a comfortable position. (C) is a cord, approximately 12" long that attaches to the first end of (A), then tied to the desired position on side of chaise lounge. (D) is a vinyl or cloth material that can be wiped or washed that covers (A).

DETAILED DESCRIPTION

Figure 2:
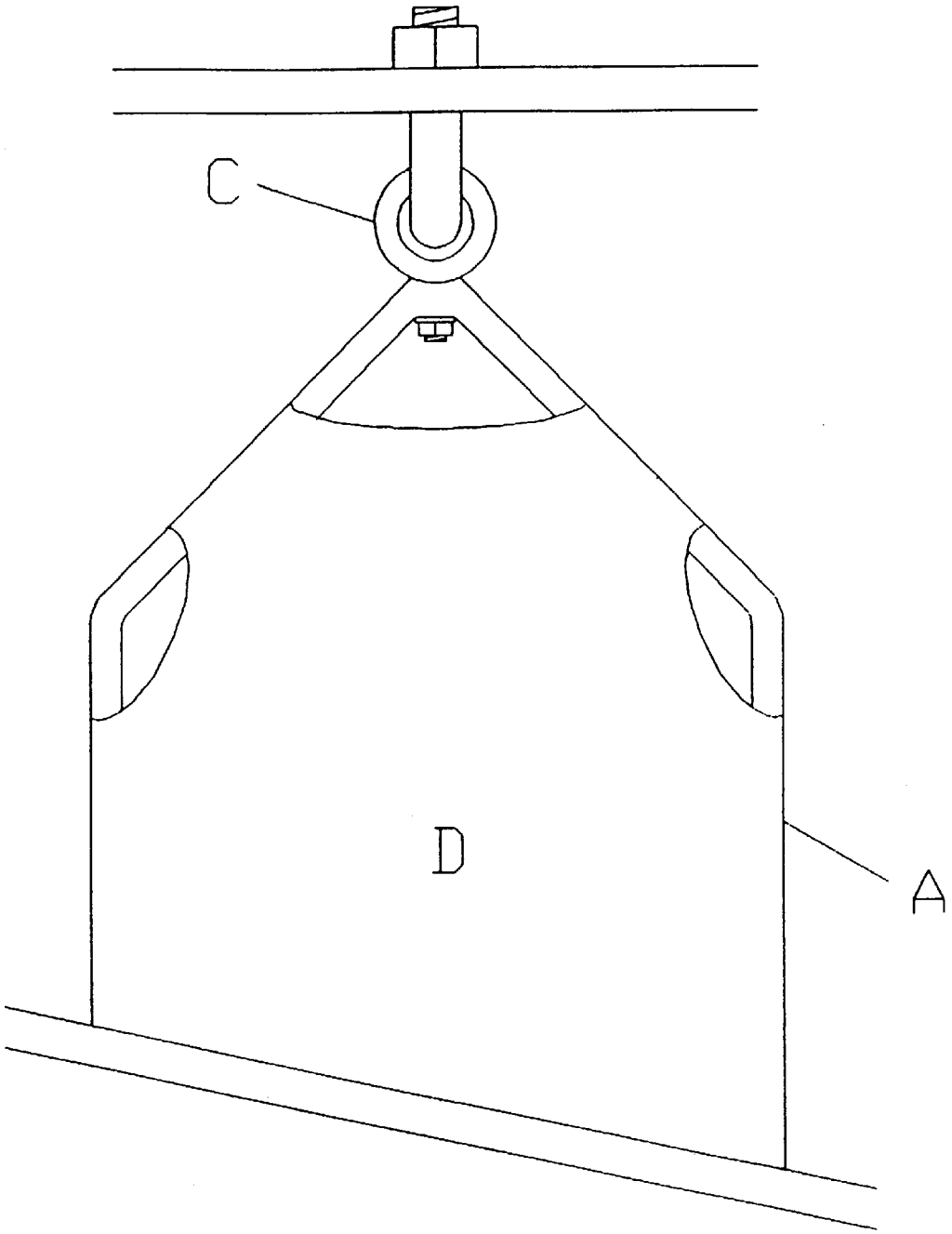
FIG. 2 is the full view of the permanent arm rest.

Referring now to illustration of FIG. 2:

Illustration of FIG. 2 is described the same as the description for illustration of FIG. 1 with (C) being the only exception. Instead of (C) being a cord as shown and described in FIG. 1 (C) will be two interlocking eyebolts with a center hole that secures the arm rest to a chaise lounge by means of a screw and nut.

DETAILED DESCRIPTION

Figure 3:
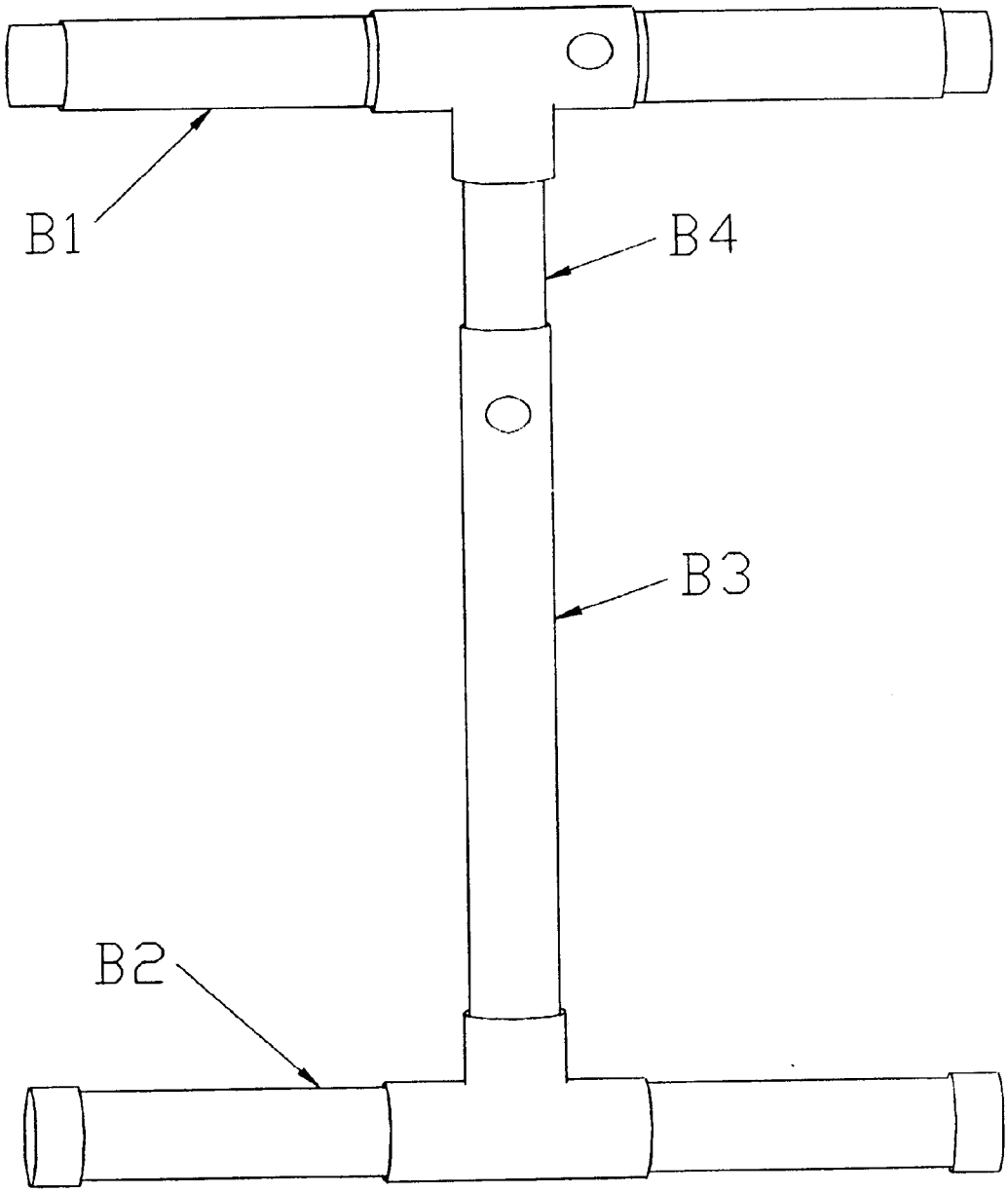
FIG. 3 is the full view of adjustable leg of arm rest.

Referring now to illustration of FIG. 3:

Illustration of FIG. 3 is a detailed drawing of (B) from illustration of FIG. 1. (B) is the adjustable, collapsible leg. (B-1) is the top of adjustable collapsible leg which is part of (A) of the arm rest at the first end. (B-2) is the bottom of adjustable collapsible leg that rests on flat surface. (B-3) is a fixed non-movable part of leg. (B-4) is the adjustable inner tube of (B-3). This tube slides up and down into (B-3) to the desired height for comfort and is then locked into place by a plastic or aluminum pin, which you insert into the hole on (B-3) which lines up with holes on (B-4). When transporting, the leg can fold and collapse under the arm rest by removing the pin from the hole of (B-1),and then proceed folding the leg under (A) and re-locking with pin into hole of (B-1).

The reverse is needed to bring leg back down and lock into a fixed position so as not to collapse when in use.

DETAILED DESCRIPTION

Figure 4:
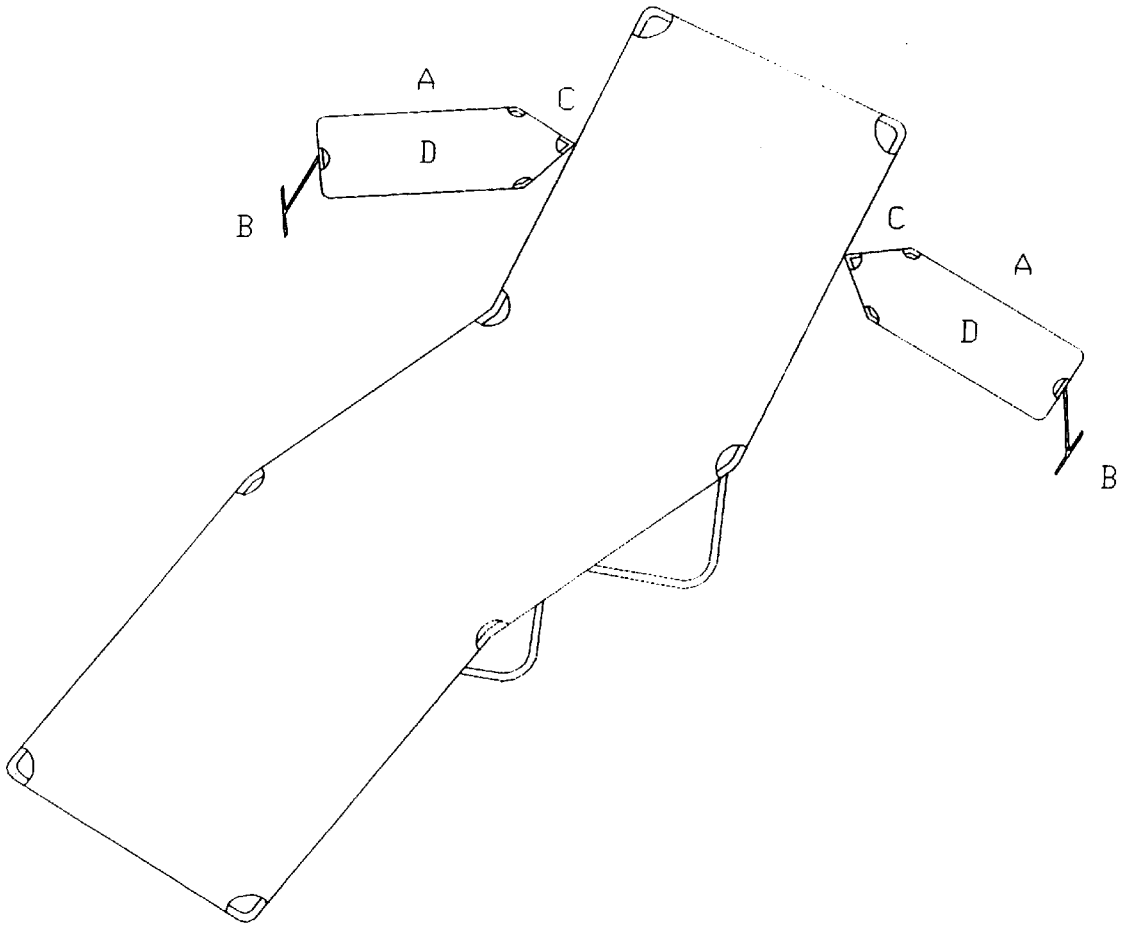
FIG. 4 is the full view depicting the portable and permanent arm rest after being attached to a chaise lounge.

Referring now to illustration from FIG. 4:

Illustration of FIG. 4 gives an overall view of approximately where the arm rests attached to a chaise lounge and how, after doing so the arm rests will look. The arm rests can be attached high or low depending on the comfort of the user.

What is claimed is:

1. An arm rest adapted for use with a lounge chair, wherein the arm rest comprises:

A. a tubular frame having five sides, wherein two sides of the tubular frame are elongated, parallel to each other, spaced apart and of approximately equal length; each of the two parallel sides having two ends, the first end of one side being located opposite the first end of the other side to form a first pair of corresponding ends, and the second end of one side being located opposite the second end of the other side to form a second pair of corresponding ends;

wherein a third side of the tubular frame is of a shorter length than the two parallel sides and is located opposite the lounge chair; the third side being connected at approximately 90° angles to the first pair of corresponding ends; and wherein the fourth and fifth sides of the tubular frame are of approximately equal length and are located in close proximity to the lounge chair; the fourth and fifth sides being connected at angles of less than 90° to the second pair of corresponding ends, the remaining ends of the fourth and fifth sides being connected at a point in close proximity to the lounge chair;

B. a covering material which connects with each side of the tubular frame;

C. a support for the arm rest and adjustable in a vertical direction; and

D. means for connecting the arm rest to the lounge chair.

2. An arm rest as defined in claim 1 wherein the tubular frame consists essentially of aluminum.

3. An arm rest as defined in claim 1 wherein the tubular frame consists essentially of polyvinyl chloride.

4. An arm rest as defined in claim 1 wherein the covering material is a vinyl material.

5. An arm rest as defined in claim 1 wherein the covering material is a cloth material.

6. An arm rest as defined in claim 1 wherein the support is connected to the third side of the tubular frame.

7. An arm rest as defined in claim 1 wherein the connecting means is a cord.

8. An arm rest as defined in claim 1 wherein the connecting means is at least one eyebolt in combination with a screw and nut.

* * * * *